United States Patent [19]

Krause

[11] 4,251,112

[45] Feb. 17, 1981

[54] APPARATUS FOR PIVOTALLY POSITIONING A CLEARING SHIELD FOR A DRUM-CUTTER MINING MACHINE

[75] Inventor: Rolf Krause, Essen, Fed. Rep. of Germany

[73] Assignee: Geb. Eickhoff Maschinenfabrik und Eisengiesserei m.b.H., Bochum, Fed. Rep. of Germany

[21] Appl. No.: 44,790

[22] Filed: May 31, 1979

[30] Foreign Application Priority Data

Jun. 3, 1978 [DE] Fed. Rep. of Germany ..... 2824475

[51] Int. Cl.[3] ..... E21C 27/24; E21C 35/20

[52] U.S. Cl. ..... 299/45

[58] Field of Search ..... 299/45, 67

[56] References Cited

U.S. PATENT DOCUMENTS

| | | | |
|---|---|---|---|
| 3,482,879 | 12/1969 | Droste et al. | 299/45 |
| 4,068,894 | 1/1978 | Dring | 299/45 |

FOREIGN PATENT DOCUMENTS

| | | | |
|---|---|---|---|
| 1106435 | 3/1968 | United Kingdom | 299/67 |
| 1271020 | 4/1972 | United Kingdom | 299/45 |

*Primary Examiner*—Ernest R. Purser

*Attorney, Agent, or Firm*—Thomas H. Murray; Clifford A. Poff

[57] ABSTRACT

A rotary actuator is supported within the cutter drum of a drum-cutter mining machine for pivotally positioning a clearing shield about the outer peripheral surface of the cutter drum. A holder used to pivotally support the clearing shield from the cutter drum is resiliently coupled to an outer ring member of the rotary actuator. An inner ring of the actuator encircles a reduction drive gear for the cutter drum and is connected thereto by bolt fasteners that extend through projections from the inner ring while received in recesses in the reduction drive gear. The bolt fasteners resist loading in the axial direction of the drum; while spring members between the reduction drive gear and the inner ring absorb peripheral loading.

5 Claims, 3 Drawing Figures

APPARATUS FOR PIVOTALLY POSITIONING A CLEARING SHIELD FOR A DRUM-CUTTER MINING MACHINE

BACKGROUND OF THE INVENTION

This invention relates to an underground mining machine of the type having a pivot arm supporting a cutter drum to rotate about an axis for working a mine face while a clearing shield is positioned at a desired location about the periphery of the cutter drum. More particularly, the present invention relates to such a mining machine wherein the clearing shield is pivotally positioned by a rotary actuator while operatively supported within the cutter drum.

In West German patent publication No. P 26 48 881.3, there is disclosed a system for pivoting a clearing plate for a drum-cutter mining machine in which the clearing plate is mounted for pivotal movement about the rotational axis of the cutter drum. A hydraulic motor, used for the pivotal movement, engages a gear element situated centrally with respect to the rotational axis of the cutter drum and disposed within the plane of the pivoting gear element. The present invention seeks to provide an improved construction and arrangement of parts for the pivotal movement of a clearing shield.

SUMMARY OF THE INVENTION

It is an object of the present invention to provide a pivoting system for a clearing shield of a drum-cutter mining machine wherein a rotary actuator is employed for the pivoting movement of the clearing shield and the actuator is compactly disposed within the cutter drum where it is protected from possible damage by debris.

More particularly, according to the present invention, there is provided in an underground mining machine having a pivot arm supporting a cutter drum to rotate about an axis for working a mine face, a clearing shield apparatus including a clearing shield spaced outwardly from the periphery of the cutter drum, holder means movable about the axis of rotation of the cutter drum for carrying the clearing shield, the cutter drum including support means to carry the holder means, and a rotary actuator coupled to pivot the holder means about the aforesaid rotational axis relative to the support means for positioning the clearing shield about the outer periphery of the cutter drum.

Thus, according to the present invention, the holder for the clearing shield and the part used for pivotal support thereof are movable with respect to one another by means of a rotary actuator. A pivoting system for a clearing shield constructed in this manner is protectively accommodated within the cutter drum which also encloses a drive reduction gear for the cutter drum. The pivoting system does not increase the overall width of the mining machine in the area of the cutter drum. The pivoting system is used to move the clearing shield from one peripheral side of the cutter drum to the opposite peripheral side. The shield is movably guided while displaced about the rotational axis of the cutter drum and held at the desired position during the actual mining operation.

Advantageously, the rotary actuator is disposed immediately adjacent the holder for the clearing shield and inside the cutter drum. The actuator has an inner ring which at least partially surrounds a reduction gear for the cutter drum and connected to rotate therewith.

An outer ring of the actuator is connected to the holder for the clearing shield. The interconnection between the inner ring and the reduction gear takes the form of projections from the inner ring extending into peripheral recesses in the reduction gear where they are retained by screw fasteners used to transmit axial loads. Adjusting springs are disposed between the inner ring and the reduction gear to absorb peripheral loading.

According to a still further feature of the present invention, damping members are provided between the clearing shield holder and the rotary actuator to form a radial and an axial interconnection that is elastic in nature. The use of such damping members insures that dynamic forces acting on the clearing shield holder during the mining of materials are not transmitted to the rotary actuator.

These features and advantages of the present invention as well as others will be more fully understood when the following description is read in light of the accompanying drawings, in which.

Figure 1:
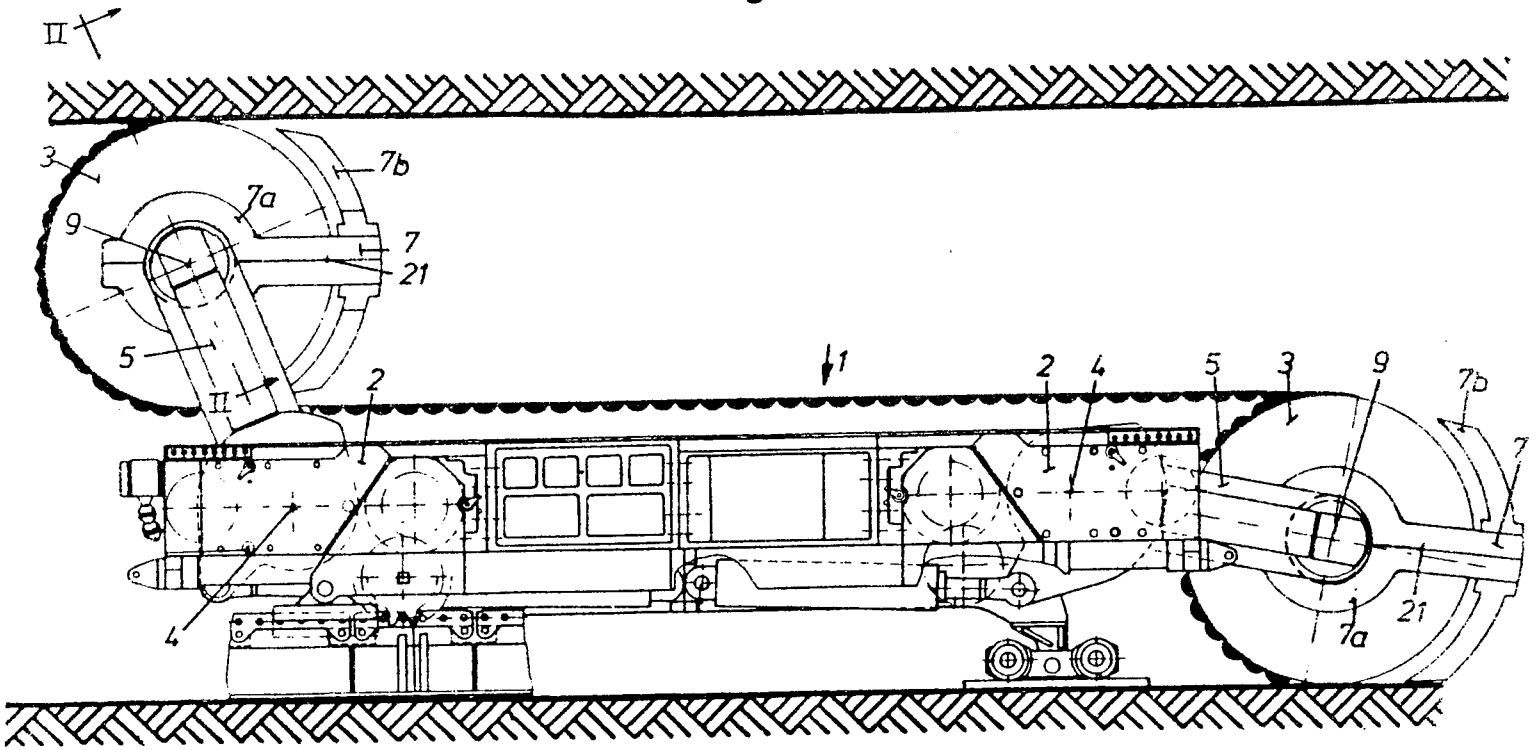
FIG. 1 is a side elevational view of a drum-cutter mining machine embodying a clearing shield apparatus according to the present invention.
Figure 2:
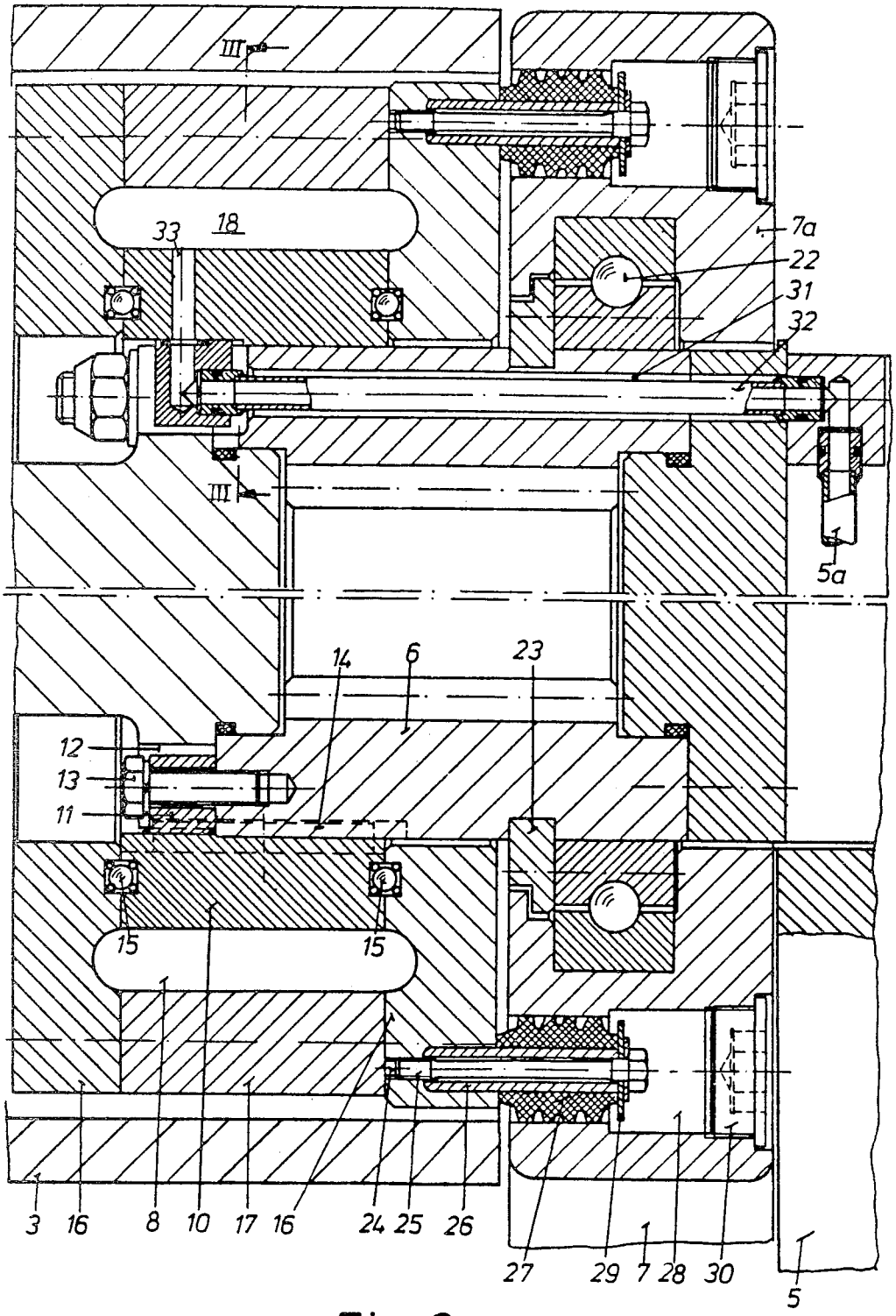
FIG. 2 is an enlarged sectional view taken along line II—II of FIG. 1.

In FIG. 1, there is illustrated a drum-cutter mining machine 1 which is supported for movement along a mine face in a manner per se well known in the art. The mining machine includes a cutter head 2 and a cutter drum 3 associated therewith at each end of the machine. Each cutter drum is mounted for vertical adjustable movement by means of arm 5 which is pivotal about axis 4 in the cutter head. A clearing shield holder 7 carries a clearing plate 7B at an outwardly-spaced relation from the peripheral surface of the cutter drum for pivotal movement about rotational axis 9 of the drum. Holder 7 is carried by a split-pivoting ring 7A which is, in turn, supported by reduction gear 6 (FIG. 2) on pivot arm 5. The reduction gear 6 is situated generally within the cutter drum 3. As shown in FIG. 2, a rotary actuator 8 is disposed in a generally surrounding relation about the outer periphery of the reduction gear 6 to rotate therewith. Rotary actuators of the type suitable to carry out the present invention employ a piston to produce the requisite rotary movement and are described in published brochures by Sudhydraulik Marktoberndorf, Steinbach KG of West Germany.

Figure 3:
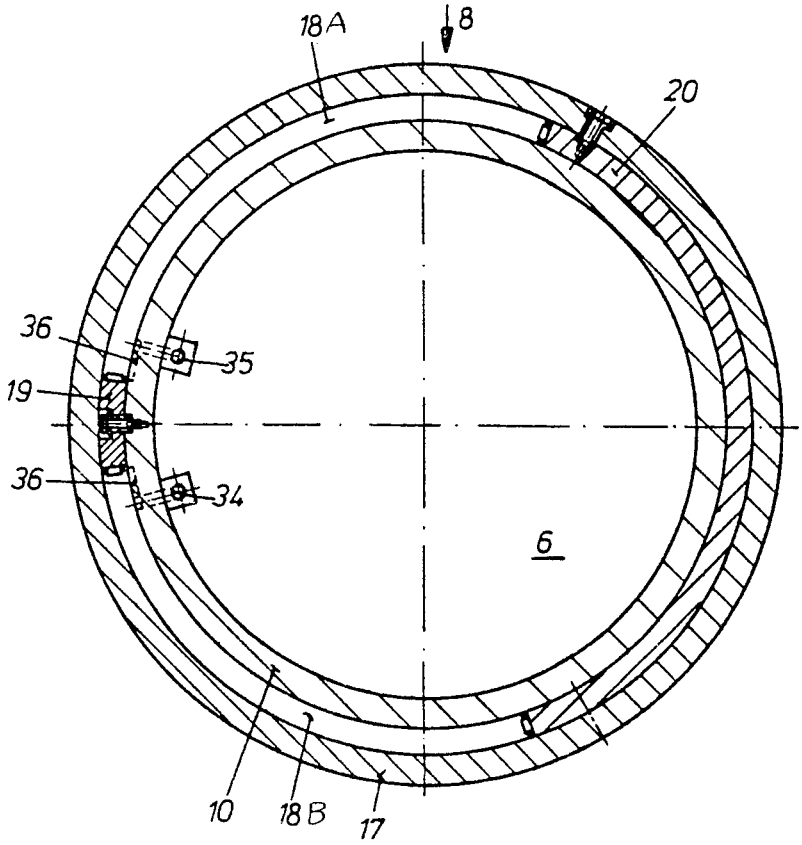
FIG. 3 is a sectional view taken along line III—III of FIG. 2.

The rotary actuator 8 includes an inner ring 10 with projections 11 arranged to extend into peripheral recesses 12 formed in reduction gear 6. The projections 11 are secured in recesses 12 by bolt fasteners 13. Adjusting springs 14 are arranged between the inner ring 10 of actuator 8 and the reduction gear 6 for receiving peripheral loads that occur with pivotal movement of plate 7B. Inner ring 10 of actuator 8 is fixed in this manner for non-rotation with respect to the reduction gear 6. Bearings 15 at each lateral side of inner ring 10 provide guided rotation for lateral rings 16 which are rigidly connected to an outer ring 17. An annular space 18 is thus formed between the outer and inner rings 10 and 17. As shown in FIG. 3, this annular space is subdivided into annular segments 18A and 18B by a segment 19 which is bolted to the inner ring 10 and a relatively longer segment 20 which is bolted to the outer ring 17. Segment 20 is mounted to move with outer ring 17.

The holder 7 is made up of two halves for structural reasons and the two halves are joined together along joint line 21 which extends diametrically across the pivoting ring 7A. By constructing the holder from two adjoined halves, it is possible to locate a roller bearing 22 for support within machined recesses provided in the halves forming the pivot ring 7A. The bearing 22 is, in turn, received on the periphery of reduction gear 6. The bearing is secured together with holder 7 against axial movement by a ring 23. The ring 23 is engaged within a recess provided in reduction gear 6. The pivoting ring 7A of holder 7 and the lateral ring 16 adjacent thereto are provided with aligned bores 28 and 24, respectively, which are distributed about a diameter. A screw bolt 25 extends into bore 28 which is larger than the bore 24 in ring 7A to engage with screw threads in bore 24. Each bolt 25 is passed through a sleeve 26 on which a damping member 27 is mounted. The sleeve 26 is pressed in an axial direction by bolt 25 against the ring 16 of actuator 8. The damping member is radially clamped inside the bore 28. For this purpose, a washer 29 is arranged between the head of the bolt and the damping member 27 such that the washer also engages sleeve 26. This relationship of parts is brought about after the bolt 25 is threadedly received in bore 24 of actuator 8. A plug 30 is used to provide a dust-proof closure for the bore 28. All of the spaced-apart damping members 27 uniformly receive torque produced on holder 7 and plate 7B by actuator 8. Moreover, the damping members not only elastically receive the adjusting forces developed for moving the clearing shield and transmit the forces generally and without impact to holder 7 and pivot ring 7A, but also prevent dynamic stresses on holder 7B from acting both radially and axially upon the actuator 8.

A hydraulic pump, not shown, is situated in the cutter head 2 of the mining machine 1 to deliver pressurized fluid through a supply line 5A in arm 5 to an axial bore 31 in reduction gear 6. The pressurized fluid is conducted by a pipe 32 into a radial bore 33 extending through the inner ring 10 of the actuator. A corresponding discharge bore, not shown, is also provided in the inner ring 10 and is connected to a return line that extends in the same manner as the supply line 5A to the hydraulic pump. As shown in FIG. 3, the outlet and inlet bores 34 and 35 in the inner ring are on opposite end faces of segment 19 where the bores communicate by way of recesses 36 with the segmented end faces. In this way, the divided annular spaces 18A and 18B are supplied alternatively with pressurized fluid even when segment 20 is moved into an abutting position with an end face of segment 19. The supply of pressurized hydraulic fluid and the return thereof from annular spaces 18A and 18B is controlled by a selector valve such that when fluid is delivered to one of the spaces, the other space is coupled to communicate with the sump of the pump. The present invention, therefore, enables the supply of pressurized hydraulic fluid to one or the other of spaces 18A, 18B and to conversely connect one or the other of the spaces to the sump. In addition, by means of the selector valve, both the inlet and outlet bores 34 and 35 can be simultaneously blocked whereby the shield 7B is locked at a desired position after pivotal movement has been carried out.

Although the invention has been shown in connection with a certain specific embodiment, it will be readily apparent to those skilled in the art that various changes in form and arrangement of parts may be made to suit requirements without departing from the spirit and scope of the invention.

I claim as my invention:

1. In an underground mining machine having a pivot arm supporting a cutter drum to rotate about an axis for working a mine face, the combination therewith of a clearing shield apparatus including a clearing shield spaced outwardly from the periphery of the cutter drum, holder means movable about said axis for carrying said clearing shield, said cutter drum including support means to carry said holder means, and a rotary actuator means supported to extend from within said cutter drum and coupled to pivot said holder means about said axis relative to said support means for positioning the clearing shield about the outer periphery of said cutter drum.

2. The combination according to claim 1 wherein said support means includes a reduction gear member within said cutter drum, and wherein said rotary actuator means includes an inner ring coupled to rotate with said reduction gear member within said cutter drum, and an outer ring member coupled to said holder means.

3. The combination according to claim 2 wherein said inner ring member includes projections, and said reduction gear member has peripheral recesses arranged to receive said projections.

4. The combination according to claim 3 further including fastening members to retain said projections within the recesses of said reduction gear member for transmitting axial loading to the inner ring member, and spring members between said inner ring member and said reduction gear member for receiving peripheral loading.

5. The combination according to claims 1, 2, 3 or 4 further including damping members to elastically interconnect said holder means and said rotary actuator means.

* * * * *